United States Patent [19]

Bachi et al.

[11] Patent Number: 4,520,944

[45] Date of Patent: Jun. 4, 1985

[54] OPEN-ENDED CONTAINER CLOSURE

[75] Inventors: Robert W. Bachi, Itasca; Phillip L. Bachi, Schaumburg, both of Ill.

[73] Assignee: Bachi, Inc., Itasca, Ill.

[21] Appl. No.: 604,167

[22] Filed: Apr. 26, 1984

[51] Int. Cl.[3] ..... B65D 11/00

[52] U.S. Cl. ..... 220/305; 40/16.2; 40/16.6

[58] Field of Search ..... 220/305, 345, 350, 314, 220/323, 324; 40/16.2, 16.4, 16.6; 206/560; 229/15

[56] References Cited

U.S. PATENT DOCUMENTS

| | | | |
|---|---|---|---|
| 2,457,966 | 1/1949 | Zaidan . | |
| 2,506,600 | 5/1950 | Kassovic . | |
| 2,665,038 | 1/1954 | Fowler . | |
| 3,021,186 | 2/1962 | Immermann | 40/16.2 X |
| 3,320,690 | 5/1967 | Forsburg | 40/16.6 X |
| 3,393,794 | 7/1968 | Borin . | |
| 3,407,938 | 10/1968 | Walter et al. | 206/449 X |
| 3,523,608 | 8/1970 | Miller . | |
| 3,664,492 | 5/1972 | Wallace . | |
| 3,958,788 | 5/1976 | Feibelman | 40/16.2 X |
| 4,146,278 | 3/1979 | Seitel . | |
| 4,342,403 | 8/1982 | Badtke et al. | 220/350 X |
| 4,347,967 | 9/1982 | Loudermilk, Jr. | 229/15 X |
| 4,358,047 | 11/1982 | Raubenheimer | 229/15 |

*Primary Examiner*—Steven M. Pollard
*Attorney, Agent, or Firm*—Quarles & Brady

[57] ABSTRACT

A closure for an open-ended container such as a tray wherein the closure element is easily inserted into the tray so as to retain the tray contents but is quickly removed therefrom to facilitate dispensing of the container contents. The container walls are formed with slots which open to the outside of the container as well as extend transversely through the walls. A locking element in the form of an elongated strip of material is inserted into the slots from the outside of the container and is retained therein in a manner such that removal without bending the strip material is substantially impeded. To remove the locking strip member from the slot, all that is required is a pulling action transversely to the container walls which will permit its withdrawal and opening of the tray-like container for dispensing of its contents. In one embodiment, a keyhole slot has curved and stop surfaces to permit insertion of the strip member in an undeflected and flat state while in another, the slot is constructed so that the locking strip member is introduced into the slot and retained therein in a deflected manner.

23 Claims, 6 Drawing Figures

OPEN-ENDED CONTAINER CLOSURE

BACKGROUND OF THE INVENTION

This invention relates to a closure for a container of the cartridge type. More particularly, it relates to a retentive type closure which is formed in conjunction with the container walls wherein a slot of the keyhole type is provided for reception of a strip-like material which when inserted is retained therein and is not readily removed in the direction of insertion yet is readily removed laterally therefrom to permit access to the container contents.

In U.S. Pat. No. 2,665,038 there is disclosed a strip-like closure element for use in conjunction with a compressible tube to act as a closure for the container aperture. In U.S. Pat. No. 3,523,608 a strip of material is indicated for use in opening a formed plastic package whereas in U.S. Pat. No. 3,393,794 strip-like slide members 30 and 32 are utilized as valve members to disperse the contents of a container. The prior art does not provide a closure system for a container tray which can be readily inserted into the tray so as to prevent removal of its contents yet is readily removed from the container so as to permit a dispensing of the contents therefrom.

It is an object of the present invention to provide a simplified closure for a cartridge-type container. Other objects are a container closure which is readily adaptable to tray-like container designs; which can be placed in a container yet removed therefrom in a fast and efficient manner; which can be highly automated for high production efficiency; and which can be constructed from readily available materials thus contributing further to its reduced cost.

SUMMARY OF THE INVENTION

These and other objects of the invention and the shortcomings of the prior art will be overcome by the present closure as well as a method of its application wherein a slot will be placed in at least one wall member of an open-ended container with the slot opening into the wall from the outside thereof and extending through the wall member in a transverse manner. Preferably, two such slots will be positioned in two spaced apart walls in a substantially coaxial manner with respect to each other. A locking member in the form of a flat and elongated strip of flexible or bendable material will be inserted into the slots. The locking member and the slot are arranged to retain the locking member in the slot and prevent removal therefrom in a first direction in which the locking member was inserted yet will permit removal therefrom by a force acting in a direction substantially transverse to the first direction. In one embodiment, the slot member is in the form of a keyway with a stop portion and a curved or raised portion spaced from a stop portion with the stop portion and the curved portion arranged to provide retention of the locking member. In another embodiment, the slot has a generally T-shaped configuration and the locking member is dimensioned to be retained in the slot in a deflected or deformed condition.

A novel method is also presented for providing the closure of this invention wherein the locking strip-like member is susceptible to automatic handling in that it can be inserted into the keyway slots of the container in a first given direction with retention in the slot yet can be readily removed by a straight pull action from the side of the container. Automation is further facilitated by the fact that the locking strip member can be supplied from a continuous source and cut to predetermined lengths in a continuous manner by machine operation. Placement of the locking strip member in the keyway slots is effected by placement forces applied in a uniform manner and at a multiplicity of points along the longitudinal axis thereof and preferably between each wall member of the container.

BRIEF DESCRIPTION OF THE DRAWINGS

The better understanding of the closure of this invention as well as a method of its use will be accomplished by reference to the drawings wherein.

DESCRIPTION OF THE EMBODIMENTS

Figure 1:
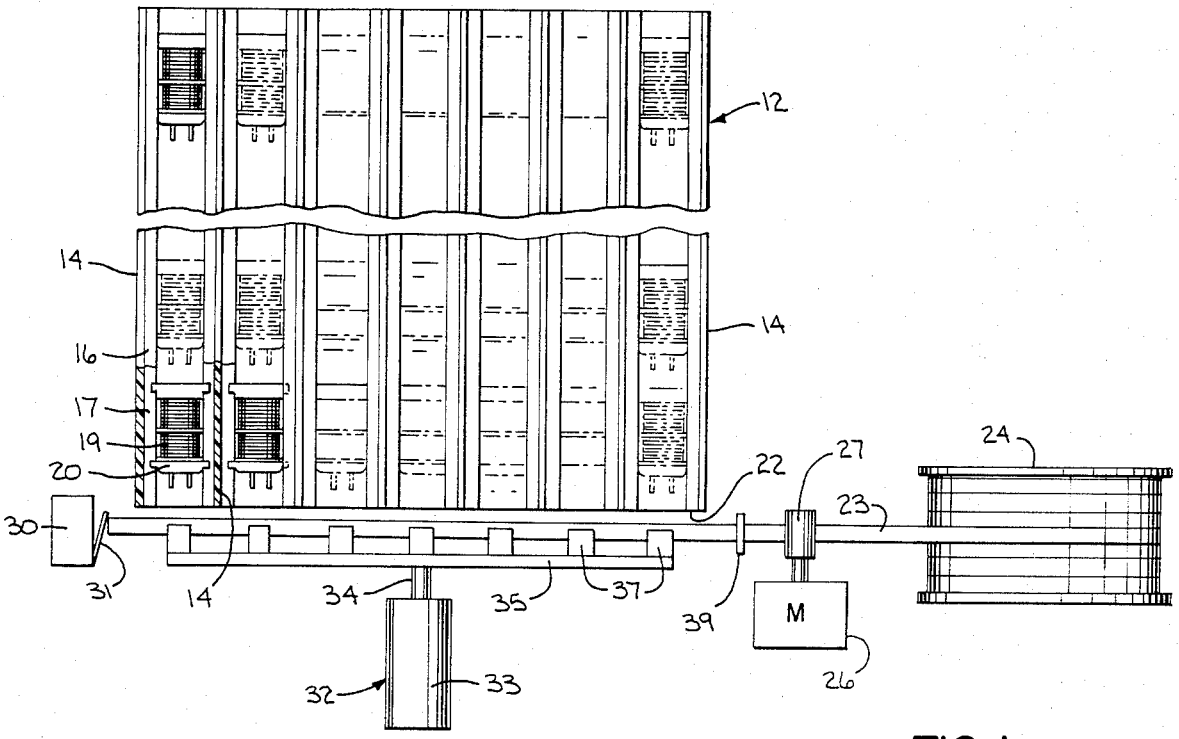
FIG. 1 is a top plan view and partially broken away illustrating a method of positioning a locking strip member in conjunction with a cartridge-type container.
Figure 2:
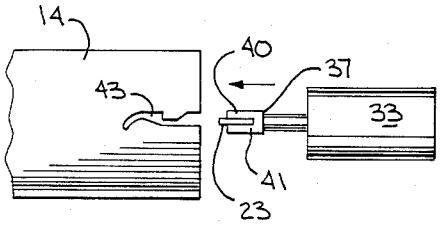
FIG. 2 is a partial view in side elevation showing the orientation of the positioning member with the locking member and prior to insertion into a slot in the container wall.
Figure 3:
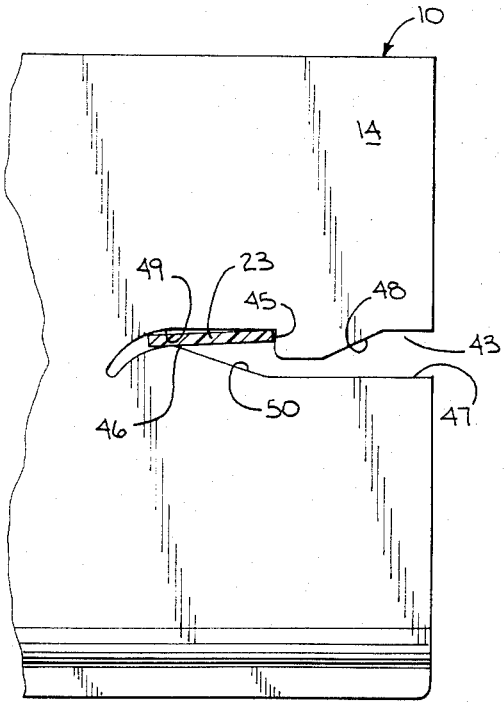
FIG. 3 is an enlarged view in side elevation illustrating the locking strip member in vertical section and in a locking position in the container.

Proceeding to a detailed description of one embodiment of the invention, reference is made to FIGS. 1–3 where the container closure generally 10 will include a cartridge container 12 having a series of adjacent and parallel spaced apart walls 14 which are flat sided. Walls 14 will have the usual upper and lower ledges 16 and 17, respectively, for capturing the front and back flanges 20 and 21, respectively, of a typical coil 19. As specifically shown in FIG. 1, a length of strip material 23 will be supplied from a supply reel 24 and moved into position by means of motor 26 with drive roll 27. A limit switch 30 with switch acutator arm 31 will control the extent that the strip material is moved in relation to container 12. A positioning device generally 32 is represented by cylinder 33 and cylinder rod 34 and includes a header 35 with holders 37. Holders 37 have upper and lower jaws 40 and 41 for retention of strip material 23 therebetween. This is best illustrated in FIG. 2.

Referring specifically to FIG. 3, it will be seen that a slot 43 is provided in wall 14 and is of a keyhole-type configuration having a straight wall portion 47 and a ramp portion 48 providing an entrance thereto. A second ramp portion 50 is disposed opposite a stop portion 45. Curved portions 46 and 49 are spaced from each other to allow a seating of strip material 23 therein and also to aid in positioning it against stop portion 45.

Figure 4:
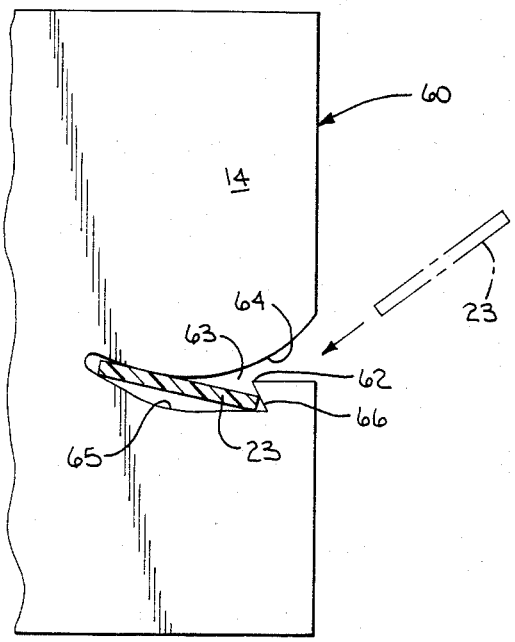
FIG. 4 is a view similar to FIG. 3 except showing another embodiment.

The embodiment 60 of FIG. 4 is somewhat similar to embodiment 10 of FIGS. 1–3 in that it includes wall panels such as 14 with slots 63 having a curved portion 64 and a substantially elongated U-shaped portion 65 for receiving locking strip material 23 therein and against an undercut portion 66.

Figure 5:
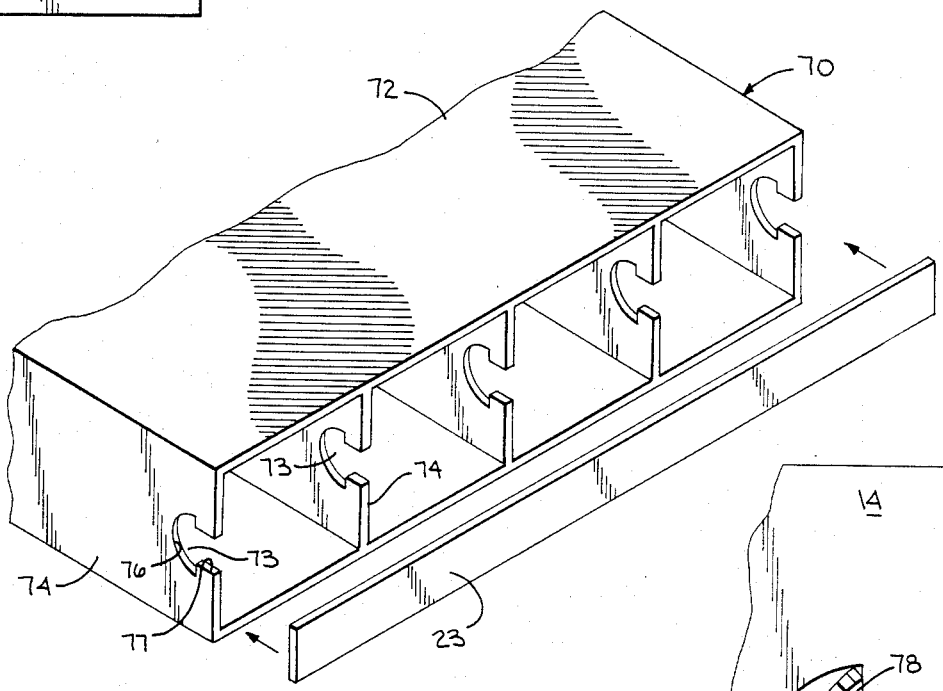
FIG. 5 is a view in top perspective illustrating yet another embodiment of this invention.
Figure 6:
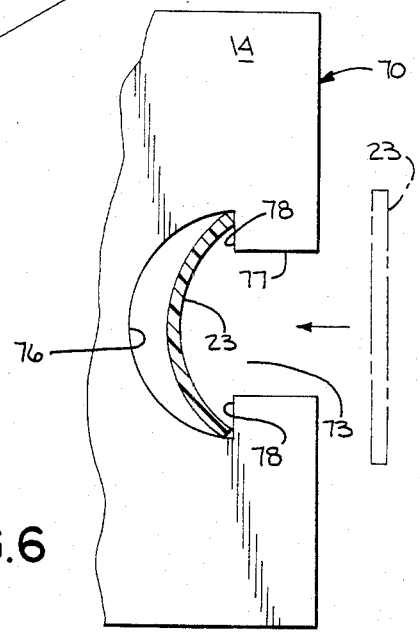
FIG. 6 is a detailed view of a portion of the container locking closure of FIG. 5 illustrating the locking bar member both prior to insertion and after being retained in the wall slot of the container.

FIGS. 5 and 6 represent an embodiment generally 70 wherein a keyhole or keyway sot 73 is provided in spaced apart walls 74. In this instance, slots 73 are of a generally T-shaped configuration with a rounded head portion 76 and a straight wall opening 77. As will be seen in conjunction with FIG. 6, locking strip 23 is retained in the head portion 76 of slot 73 in a deflected condition in that in order to be placed therein it must be bent to a slight degree. In this manner it will contact the shoulder portions such as 78 of slot 73 when it is retained therein.

A further understanding of the advantages of the present container closures will be appreciated with respect to the method by which they are utilized. Considering embodiment 10 first, it will be seen that the closure system can be highly automated in that the strip-like locking material 23 can be continuously supplied by means of supply reel 24 which is accomplished through the activation of motor 26 and drive roll 27. A predetermined length of material is supplied which would be that length to extend over the width of cartridge container 12 with a small portion extending beyond each side for gripping purposes. At this stage, the supply reel motion will be stopped through the contact of the strip material with switch arm 31 engaging limit switch 30. At this point the suitable length of strip material will be severed such as indicated by a cutting device 39. In this position, the length of strip material 23 will be engaged in upper and lower jaws 40 and 41 of holders 37 such as indicated in FIG. 2. Previously, slots such as 43 will have been provided in all of the vertical wall sections 14 of container 12 and will be aligned in a substantially co-axial manner as indicated for slots 73 in embodiment 70. Strip material will then be aligned with the opening of slot 43 and moved in the direction of container 12 with holders 37 positioned between the walls 14. As the holders 37 move between the walls, flexible strip 23 will be positioned into slot 43 where it will ride over straight wall portion 47, up ramp portion 50 with the leading edge thereof being positioned between curved portions 46 and 49. During the insertion of strip material into slot 43, if for any reason the strip material should not be in close proximity to straight wall portion 47, it will be deflected downwardly and in the direction thereof by contacting ramp portion 48.

With the strip material 23 positioned in the manner indicated in FIG. 3, cylinder 23 will be activated in the opposite direction to thereby withdraw holders 37 from the strip material. This disengagement will be effected as strip material 23 is now abutted against stop portion 45 which prevents the strip material from being removed in a direction opposite to which it was placed in slot 43. Not only does this positioning of strip material 23 against stop portion 45 serve as a means of disengaging the holders 37, it also prevents the removal of the strip material from slot 43 without intentional bending so as to bypass stop portion 45. In this manner, the strip material 23 acts as a barrier to the removal of coils 19 from the front end of container 12. The container is now ready for shipment and handling purposes. It will be appreciated that when it is desired to remove the coils 19 from the container 12 all that is required is a gripping of the portion of the strip material extending beyond outer walls 14 by suitable gripping means and moving it in a straight pull manner transversely to walls 14 as well as transversely to the direction of placement therein. The coils with their associated front and back flanges 20 and 21 will ride between upper and lower ledges 16 and 17 and can be removed from the front of container 12 as indicated by the numeral 22.

The embodiment 60 of FIG. 4 represents a similar type of introduction of undeflected strip material 23 into slot 63 except instead of strip material 23 being introduced with the transverse axis parallel with the slot's longitudinal axis, it is introduced at an angle. This is indicated by the phantom line showing strip locking material 23. Curved portion 64 of slot 63 will act as a guide for positioning strip material 23 therein. The strip material 23 will be introduced into the slot until the trailing edge will clear point 62 of undercut section 66. With strip material 23 positioned in slot 63 in the manner shown in FIG. 4, holders 37 would be moved in a direction opposite the first direction for placing the strip material therein. The undercut 66 will then serve the same function as did stop portion 45 in embodiment 10. It will be appreciated that the retentive feature of this embodiment as well as its easy withdrawal from the container will be the same as previously indicated in embodiment 10.

The method of utilizing embodiment 70 is somewhat different than previously described for embodiments 10 and 60. Instead of the strip material being introduced into slots 43 and 63 with the transverse axis of the strip material substantially parallel or angular with the slot, the strip material 23 will be introduced with the transverse axis parallel with the front surface of walls 74 and in a deflected condition in a manner such that it will pass through the opening 77 of slot 73. This deflection is required as the transverse axis of strip material 23 is larger than the height of opening 77. Once positioned in the head portion 76 of slot 73 and as indicated specifically in FIG. 6, strip material 23 will be captured therein and cannot be removed except by further deflection. In this particular manner it can be seen that opposing ends of strip material 23 will be locked against shoulders 78 and the retentive feature thereof will be the same as indicated in the previous embodiments. It will be further appreciated that withdrawal of the strip material 23 for the purpose of removing the contents of container 72 is simply effected by exerting the force either a pulling or pushing force transversely to walls 74.

In the previous description of embodiment 10 specifically described in FIG. 3, curved portion 46 is depicted in conjunction with stop 45 to position the strip material 23 in slot 43 for retentive purposes. It will be appreciated that any form of a raised portion or hump type projection can be employed for the same purpose. While strip material 23 is indicated in FIG. 3 as being in an undeflected or flat state in slot 43, it could assume a slightly deflected or deformed state therein when positioned over a raised or humped portion with retention by stop 45. It should be further pointed out that the preferred manner of orientating slots 43, 63 and 73 in the respective adjacent walls 14 and 74 for reception of strip material 23 is in a coaxial manner. However, as strip material 23 is flexible or bendable over its longitudinal axis, perfect coaxial alignment is not required and substantial alignment will suffice. Alternatively, and if desired, due to the flexibility of strip material 23, the slots could be laterally offset in adjacent walls to the extent that strip material can be conveniently inserted. Further, while locking strip 23 has been described in conjunction with two or more adjacent flat walls such as 14, the advantages of the locking strip can be obtained with a single slotted wall with one end of the strip being supported on a ledge or similar surface. Neither is it necessary that flat walls be utilized. The locking strip 23 can be effectively employed in a tubular container with the slots in diametrically opposed positions.

The container system of this invention can be inexpensively manufactured in that the materials for fabrication are readily available and no special tooling is required. For example, containers 12 and 72 can be injection molded from highly available plastic materials such as polyvinylchloride. Similarly, bendable or flexible strip 23 is preferably fabricated from a polypropylene resinous plastic material, however other bendable plastic materials which can be extruded into band-like material can be employed as well as metal materials. The material strength requirement of strip 23 is that it be capable of intentional deflection yet rigid enough to withstand the usual contact forces of product without substantial deflection or breaking.

It will thus be seen through the present invention there is now provided a simplified closure which is economically manufactured thus making the container closure disposable. The container closure offers a unique advantage in that it is readily adaptable to automation in that the locking strip can be continuously supplied and applied to the container through automated equipment. Not only is the container closure of this invention economical from the standpoint that it employs relatively few parts but lends itself to fast and efficient use in that the locking strip is readily placed in the container for locking purposes yet readily removed in one motion.

The foregoing invention can now be practiced by those skilled in the art. Such skilled persons will know that the invention is not necessarily restricted to the particular embodiments presented herein. The invention is to be defined by terms of the following claims as given meaning by the preceding description.

We claim:

1. A closure for an open-ended container comprising:

at least one wall member;

a slot in said wall member opening into said wall member from the outside thereof in a first direction and extending through said wall member;

a locking member for temporary retentive engagement in said slot and extending over a portion of the open-ended container to provide a barrier to the contents thereof;

said locking member and said slot constructed and arranged to retain said locking member in said slot and prevent removal therefrom in said first direction yet permit removal therefrom by a force acting in a direction substantially transverse to said first direction.

2. The closure of claim 1 wherein two said wall members are spaced from each other and each said slot is positioned in a substantially coaxial manner with respect to each other.

3. The closure of claim 1 wherein said locking member is defined by a substantially flat and enlongated strip of flexible material.

4. The closure of claim 2 wherein said wall members are substantially flat sided and define in part a cartridge type container.

5. The closure of claim 3 wherein said slot has a generally T-shaped configuration and said locking member is dimensioned to be retained in said slot in a deflected or deformed condition.

6. The closure of claim 3 wherein each said slot is defined by a keyway including a stop portion and a curved or raised portion spaced therefrom, said stop portion and said curved or raised portion arranged to provide said retention of said locking member.

7. The closure of claim 3 wherein said slot is further defined by a curved walled portion on one side of said slot and an undercut portion positioned opposite said curved walled portion with a substantially U-shaped portion extending beyond said undercut portion, said U-shaped portion being of sufficient dimension to accommodate said locking member therein between said undercut portion and the end of the slot.

8. The closure of claim 4 wherein said wall members are represented by a plurality of wall members arranged in a substantially parallel manner with respect to each other.

9. A cartridge type container having an open end with an easily insertable and removable closure comprising:

a container defining a plurality of tray sections having spaced apart and substantially parallel wall members;

a slot in each said wall member opening into each said wall member from the outside thereof in a first direction and extending through each said wall member; and a locking member for temporary retentive engagement in said slot and extending over a portion of said open end to provide a barrier to the contents thereof;

said locking member and said slot constructed and arranged to retain said locking member in said slot and prevent removal therefrom in said first direction yet permit removal therefrom by a force acting in a direction substantially transverse to said first direction.

10. The cartridge type container of claim 9 wherein each said slot is positioned in a substantially coaxial manner with respect to each other.

11. The cartridge type container of claim 9 wherein said locking member is defined by a substantially flat and elongated strip of flexible material.

12. The cartridge type container of claim 11 wherein said flexible material is a polypropylene resinous plastic.

13. The cartridge type container of claim 12 wherein each said slot is defined by a keyway including a stop portion and a curved or raised portion spaced therefrom, said stop portion and said curved or raised portion arranged to provide said retention of said locking member.

14. The cartridge type container of claim 12 wherein said slot has a generally T-shaped configuration and said locking member is dimensioned to be retained in said slot in a deflected condition.

15. The cartridge type container of claim 12 wherein said slot is further defined by a curved walled portion on one side of said slot and an undercut portion positioned opposite said curved walled portion, with a substantially U-shaped portion extending beyond said undercut portion, said U-shaped portion being of sufficient dimension to accommodate said locking member therein between said undercut portion and the end of the slot.

16. A method of packaging and dispensing articles from a cartridge type container having at least one wall member and being open ended comprising:

providing a slot in said wall member with said slot opening into said wall member from the outside thereof as well as laterally therethrough;

placing a strip-like locking member into said slot from the outside thereof and in a first direction, said locking member being positioned in said slot and in conjunction with said wall member to retain said articles in said container;

arranging said strip-like member and said slot in a manner such that said strip-like member cannot be removed from said slot in a direction opposite said first direction and removing said strip-like locking member from said slot by a force acting substantially transverse to said first direction in a straight pull manner;

whereby said articles can be readily removed from said container with removal of said locking member.

17. The method of claim 16 wherein at least two said wall members are spaced from each other and each said slot is positioned in said wall members in a substantially coaxial manner.

18. The method of claim 17 wherein a placement force is applied to the said strip-like member in a uniform manner at a multiplicity of points along the longitudinal axis of said member.

19. The method of claim 18 wherein said placement force is applied between each said wall member of said container.

20. The method of claim 16 wherein said strip-like locking member is introduced in said slot while in a substantially flat and undeflected state with the transverse axis of said locking member being substantially parallel to the longitudinal axis of said slot.

21. The method of claim 16 wherein said strip-like locking member is introduced in said slot while in a substantially flat and undeflected state with the transverse axis of said locking member being positioned in an angular manner with respect to the longitudinal axis of said slot.

22. The method of claim 16 wherein said strip-like locking member is introduced in said slot while in a deflected or deformed state.

23. The method of claim 16 further including the step of supplying strip-like material from a continuous source and severing said material into preselected lengths to form said strip-like member prior to placement in said slot.

* * * * *